United States Patent [19]

Frank et al.

[11] Patent Number: 4,996,414

[45] Date of Patent: Feb. 26, 1991

[54] X-RAY IMAGE INTENSIFIER WITH ELECTRON OPTICS COATING

[75] Inventors: Richard Frank, Erlangen; Fritz-Walter Hofmann, Buckenhof, both of Fed. Rep. of Germany

[73] Assignee: Siemens Aktiengesellschaft, Berlin and Munich, Fed. Rep. of Germany

[21] Appl. No.: 413,744

[22] Filed: Sep. 22, 1989

[30] Foreign Application Priority Data

Sep. 29, 1988 [DE] Fed. Rep. of Germany ... 8812346[U]

[51] Int. Cl.[5] ..... H01J 31/50

[52] U.S. Cl. ..... 250/213 VT; 313/529

[58] Field of Search ..... 250/213 VT; 313/529, 313/537, 382, 383, 389, 390, 366, 450, 452

[56] References Cited

U.S. PATENT DOCUMENTS

| | | | |
|---|---|---|---|
| 2,151,785 | 3/1939 | Lubszynski et al. | 313/524 |
| 3,026,437 | 3/1962 | Niklas | 313/529 |
| 3,143,681 | 8/1964 | Schlesinger | 313/450 |
| 3,417,242 | 12/1968 | Windebank | 250/367 |
| 3,688,146 | 8/1972 | Bouwers | 313/496 |

FOREIGN PATENT DOCUMENTS 839681 6/1960 United Kingdom .

OTHER PUBLICATIONS

"Insulating Aluminoxide Films," Mohr et al., IBM Technical Disclosure Bulletin, vol. 6, No. 3, Aug. 1963.

"Das Roentgenfernsehen," Gebauer et al., 1974, pp. 54–57.

*Primary Examiner*—David C. Nelms

*Attorney, Agent, or Firm*—Hill, Van Santen, Steadman & Simpson

[57] ABSTRACT

An x-ray image intensifier has an electrode system for focusing electrons, produced by the incidence of x-radiation on the input luminescent screen, onto the output luminescent screen. An electrode of the electrode system is applied as a coating to the interior of a one-piece electrode substrate, which forms the envelope of the vacuum vessel of the x-ray image intensifier, and a voltage is applied to the coating so that the potential field continuously increases in the space between the input luminescent screen and the output luminescent screen.

5 Claims, 2 Drawing Sheets

X-RAY IMAGE INTENSIFIER WITH ELECTRON OPTICS COATING

BACKGROUND OF THE INVENTION

1. Field of the Invention

The present invention is directed to an x-ray image intensifier for an x-ray diagnostics installation.

2. Description of the Prior Art

Known x-ray image intensifiers generally include a vacuum vessel having an input luminescent screen and a photocathode at one end face thereof, and electron optics, fed by a voltage source, for generating an electrical field which focuses the electrons emitted by the incidence of x-radiation at a point of the input luminescent screen/photocathode onto a corresponding point of an output luminescent screen, disposed at an opposite end face of the x-ray image intensifier.

X-ray image intensifiers are used in x-ray diagnostics to convert an x-ray shadow image, produced by transillumination of a patient with x-rays, into a visible image, and to intensify the image. A video camera tube, whose output signals are supplied to a monitor via a video chain, is connected to the output of the x-ray image intensifier. The examination region is displayed as an image on the monitor.

A known x-ray image intensifier of the above type is described in the text "Das Roentgenfernsehen", Gebauer et al., 1974, pages 54–56. The electrode system in this known device has a plurality of cylindrical or annular electrodes having respectively different diameters. A different voltage is applied to each electrode for generating an electrical field for focusing the electrons produced at a point of the input luminescent screen/-photocathode onto a corresponding point of the output luminescent screen. Due to the high voltage differences of the consecutive electrodes required for the deflection of the electrons, large gradients in the electrical field are caused, particularly in the proximity of the photocathode. This results in disturbances in the electron trajectories. In particular, these disturbances causes distortion errors in the edge region of the output luminescent screen, and degrade the modulation transfer function of the system. These errors can only be compensated with significant complexity, by suitable design of the shape of the electrodes, and by increasing their number.

An x-ray image intensifier is described in U.S. Pat. No. 3,688,146, wherein the focusing electrodes are applied to the inside of the tube envelope as a metal coating, on regions of the tube envelope having differing diameters. Again, the high differences in potential in the region of the electrodes disturb the electron trajectories.

Another type of x-ray image intensifier is disclosed in British application No. 839 681, wherein a focusing electrode is applied to the inside of the tube envelope as a metal coating; however, for reducing large potential gradients, a semiconductive layer is applied to the inside of the tube envelope between a focusing electrode and the anode. In a further embodiment also disclosed in this published application, a layer of semiconductive material may also be applied to the focusing electrode of the image intensifier, to serve as a getter for free cesium iodide. The semiconductive material is provided in additon to the focusing electrode.

SUMMARY OF THE INVENTION

It is an object of the present invention to provide an x-ray image intensifier wherein the electrode system is simplified, and wherein disturbances of the electron trajectories are reduced.

The above object is achieved in accordance with the principles of the present invention in an x-ray image intensifier wherein an electrode of the electron optics, consisting of electrically resistive material, is applied as a coating on a one-piece electrode substrate which forms part of the envelope of the vacuum vessel of the x-ray image intensifier, and wherein a voltage is applied to the coating so that the potential in the region between the input luminescent screen and the output luminescent screen continuously increases with increasing distance from the input luminescent screen/photocathode or, stated another way, continuously increases with decreasing distance from the output luminescent screen.

An advantage of this structure for an x-ray image intensifier is that the number of electrodes is reduced, the lenght of the x-ray image intensifier can be shortened, and imaging errors are reduced because the potential does not suddenly change.

The coating is preferably formed of a semiconductor layer having a sheet resistance which increases with increasing distance from the input luminescent screen. The semiconductor layer may be applied to the substrate by painting or spraying. As a result of the changing sheet resistance of the coating and the voltage applied thereto, the potential field between the input luminescent screen and the output luminescent screen changes continuously, so that disturbances of the electron trajectories are negligible.

DESCRIPTION OF THE PREFERRED EMBODIMENTS

Figure 1:
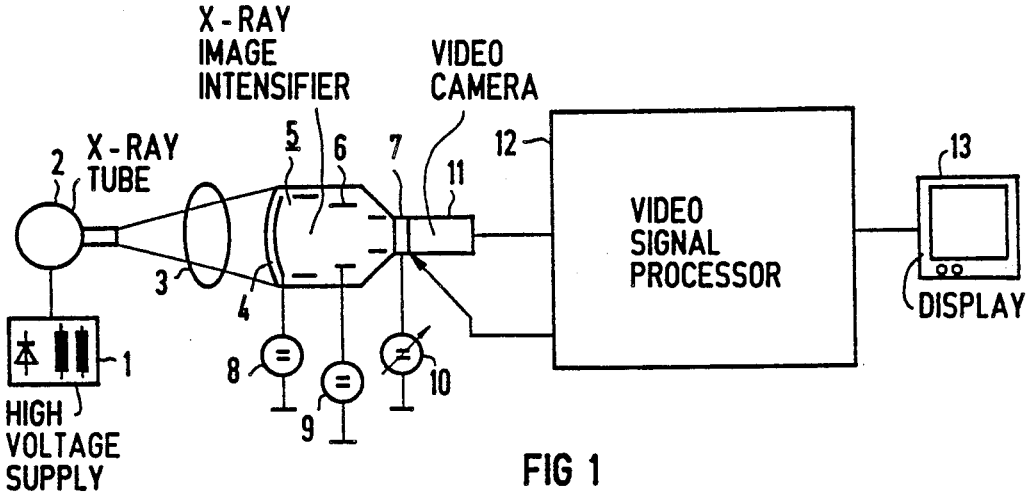
FIG 1 (PRIOR ART)
FIG. 1 is a schematic block diagram of a conventional x-ray diagnostics installation.

A conventional x-ray diagnostics installation is shown in FIG. 1. The installation includes a high voltage supply 1 which feeds an x-ray tube 2, which generates an x-ray beam in which a patient 3 is disposed. A radiation image of the patient 3 is produced on the input luminescent screen 4 of an x-ray intensifier 5. Electrons emerging from the input luminescent screen/photocathode 4 are focused onto an output luminescent screen 7 of the x-ray image intensifier 5 by the electrodes of an electron optics system 6. Voltage sources 8, 9 and 10 supply the x-ray image intensifier with the required acceleration and deflection voltages. A standard video chain including an image pick-up device 11, such as a video camera, a videosignal processor 12, and a display 13, is connected to the output of the x-ray image intensifier 5. The x-ray shadow image produced by transillumination of the patient 3 can be displayed as an image on the picture screen of the display 13 by the combined operation of the x-ray image intensifier 5 and the video chain.

Figure 2:
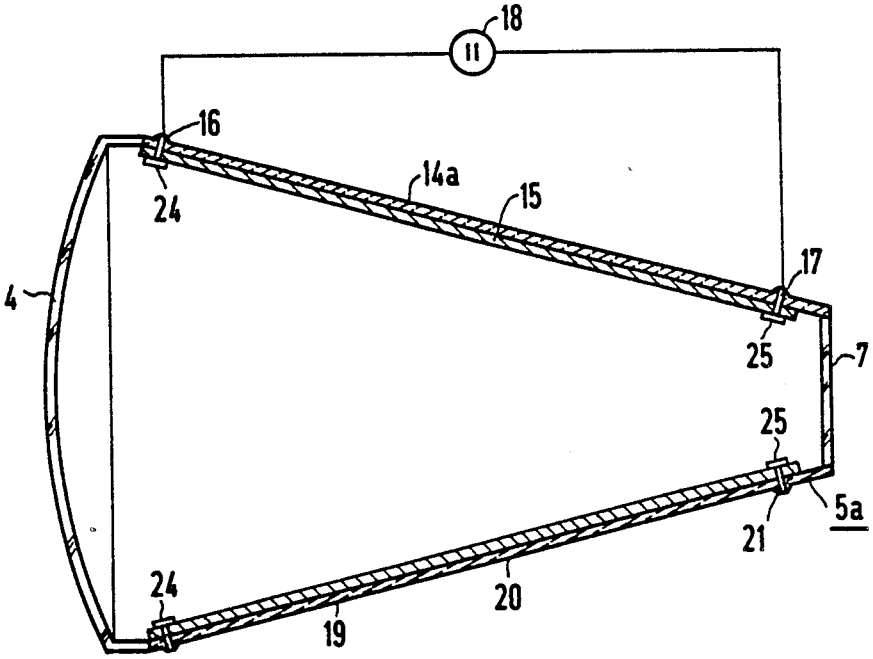
FIG. 2 is a side sectional view of an x-ray image intensifier constructed in accordance with the principles of the present invention, which can be used in the installation of FIG. 1.

An x-ray image intensifier 5*a*, constructed in accordance with the principles of the present invention, is shown in section FIG. 2. The envelope of the x-ray image intensifier 5*a* is a conical electrode substrate 14*a*, and consists of glass in the embodiment of FIG. 2. The input luminescent screen 4 and the photocathode are disposed at one end face of the x-ray image intensifier 5*a*, and the output luminescent screen 7 and the anode are arranged at the other end face thereof.

In accordance with the principles of the present invention, the electrode substrate 14*a* has a coating 15 of material having a high restistivity, such as semiconductor material, applied to the inside surface thereof. The sheet resistance of the coating 15 increases, between the input luminescent screen 4 and the output luminescent screen 7, with increasing distance from the input luminescent screen 4. For example, the coating 15 may consist of $Cr_2O_3$ applied by painting or spraying a suspension of $Cr_2O_3$on the electrode substrate 14*a*. The coating 15 may alternatively consist of a non-conductive granulate, for example $Al_2O_3$ $TiO_2$, to which controlled quantities of a metal granulate, for example Cu or Ag, are added. The conductivity of the coating 15 is then dependent on the mixing ratio of the constituents relative to each other. The mixing ratio, and thus the conductivity of the coating 15, can be continuously varied if the coating 15 is applied, for example, by plasma spraying. In this spraying process, two components can be applied on a substrate in a variable mixing ratio. The kind of the coating on substrate 14*a*, and the coating process, are not essential. It is essential, however, that the distribution of the sheet resistance of the coating 15 yields the desired potential distribution, and that it is rotationally symmetrical.

Two terminal contacts 16 and 17, for example, may be conducted through the wall of the electrode substrate 14*a* to metallic contact rings 24 and 25 for voltage supply to the coating 15. The metallic contact rings 24 and 25 are in electrical contact with the coating 15. The contacts 16 and 17 are connected to a voltage source 18. Further metallic rings may be provided, each being respectively connected to a further conductor. The coating 15, for example, may be subdivided into individual sections which are respectively connected to voltage sources via the metallic contact rings and the terminal contacts.

As a result of the voltage applied to the coating 15 and the changing surface resistivity of the coating 15, the electrical potential varies continuously, increasing from the input luminescent screen 4 to the output luminescent screen 7. No suddenly changing electrical potential fields arise in the region between the input luminescent screen 4 and the output luminescent screen 7 which may cause disturbances of the electron trajectories. For example, the voltage at the coating 15 may vary from 0 volts to +10 volts from the photocathode to the region 19, from +10 volts to +50 volts from the region 19 to the region 20, and from +50 volts to +500 volts from the region 20 to the region 21. The voltage, and thus the electrical potential, varies in continuous fashion from the photocathode next to the input luminescent screen 4 to the anode next to the output luminescent screen 7 in the region between the conductors 16 and 17.

Figure 3:
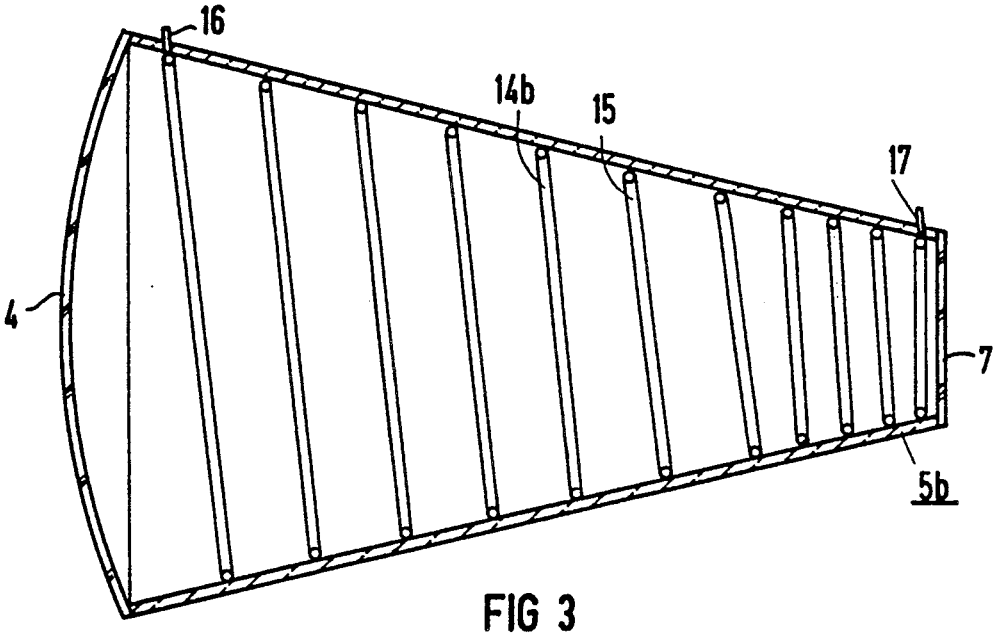
FIG. 3 is a side sectional view of a further embodiment of an x-ray image intensifier constructed in accordance with the principles of the present invention.

In the embodiment of FIG. 3, the coating 15 is helically applied to the inside of a conical electrode substrate 14*b* of the x-ray image intensifier 5*b*. The pitch of the helix decreases from the input luminescent screen 4 to the output luminescent screen 7. As a result, an especially good axial symmetry of the continuously changing potential field is achieved between the conductor 16 and the conductor 17. The gradient of the potential field from the input luminescent screen 4 to the output luminescent screen 7 is dependent on the pitch of the helix, and is thus freely adjustable.

Alternatively, the pitch of the helix may be constant in the region between the input luminescent screen 4 and the output luminescent screen 7, in which case the resistance of the turns of the helix must be varied in accordance to the desired gradient of the potential field in this region.

For example, the coating 15 may be formed by a helically wound conductor which is attached to the interior of the electron substrate 14*b*. It is also possible to introduce a coating 15 into a groove which is ground into the electrode substrate 14*b*, or to apply a helical mask on the substrate 14*b* and then to apply the coating 15 by spraying, so that the coating 15 remains on the substrate 14*b* as a helix after removal of the mask. It is also possible to apply the coating 15 on the entire interior surface of the electrode substrate 14*b* and subsequently to grind away unwanted portions of the coating 15, so that a helical coating 15 ultimately remains on the electrode substrate 14*b*.

Figure 4:
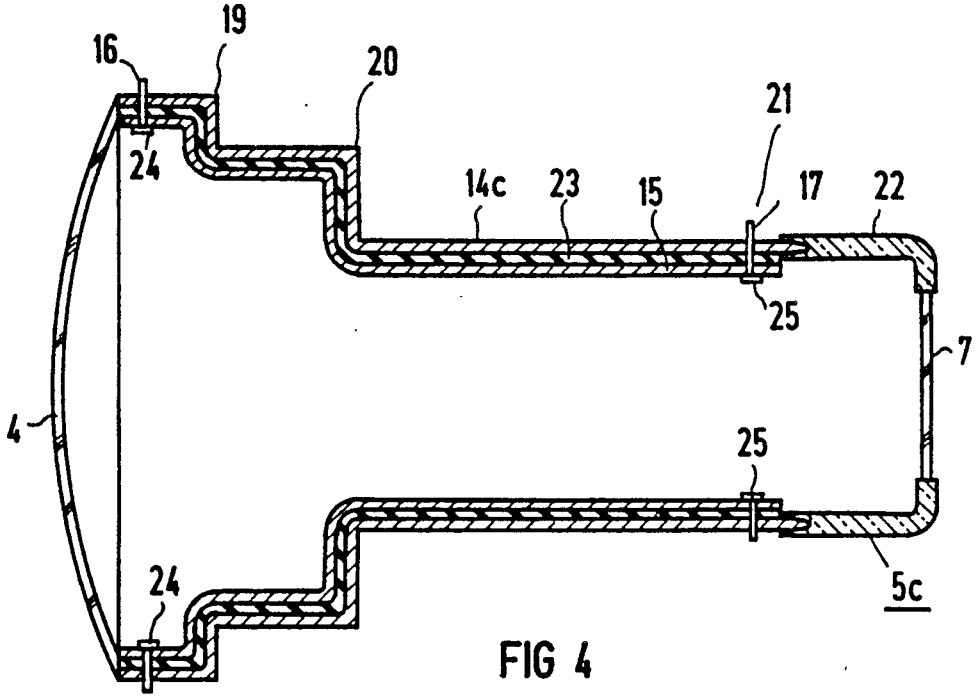
FIG. 4 is a side sectional view of another embodiment of an x-ray image intensifier constructed in accordance with the principles of the present invention.

Another embodiment of an x-ray image intensifier 5*c* is shown in FIG. 4, wherein the cylindrical envelope is stepped, when viewed from the side. The electrode substrate 14*c* in the embodiment of FIG. 4 is a one-piece metal sheet which is cylindrically shaped in stepped fashion, and which has one open end connected to and closed by the input luminescent screen 4 and its opposite end fused to a glass substrate 22 for the output luminescent screen 7. An insulating layer 23 of, for example glass, ceramic or plastic, is applied to the inside of the electrode substrate 14*c* by known application methods. The insulating layer 23 may be ommitted if the electrode substrate 14*c* consists of an insulating material, such as glass, ceramic or plastic. The coating 15 is then applied to the interior surface of the insulating layer 23 (or to the interior surface of the electrode substrate 14*c*, if it consists of insulating material). In this embodiment, as in the previous embodiments, the voltage continuously changes along the coating 15 from the input luminescent screen 4 to the output luminescent screen 7. For example, the voltage may be 0 volts in the region of the photocathode, up to 10 volts in the region 19, up to 50 volts in the region 20, and up to 500 volts in the region 21.

The inventive concept disclosed herein is not limited to the exemplary embodiments shown in FIGS. 2 through 4. An important feature of the invention is that the potential field continuously change in the region between the input luminescent screen 4 to the output luminescent screen 7. The potential field may change linearly or non-linearly, however the potential field does not change abruptly in the region between the input luminescent screen 4 and the output luminescent screen 7, and has correspondingly evenly distributed equipotential surfaces. In accordance with the principles of the present invention, therefore, the potential field does not suddenly change in the region between the input luminescent screen 4 and the output luminescent screen 7. For this purpose, the coating of electrical resistance material forms the electrode for focusing the electrons in the x-ray image intensifier disclosed herein.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray image intensifier comprising:

an input luminescent screen with a photocathode, an output luminescent screen;

a one-piece electrode substrate disposed between said input luminescent screen and said output luminescent screen and being attached vacuum tight thereto to form a vacuum vessel; and electrode for an electron optics system consisting of electrical resistance material and forming a coating on a circumferential interior surface of said electrode substrate, said coating completely covering an area between said input luminescent screen and said output luminescent screen over the entire circumference of said interior surface and adapted for connection to a voltage source so that a potential field generated in a region in said vessel between said input luminescent screen and said output luminescent screen and said output luminescent screen continuously increases with increasing distance from said input luminescent.

2. An x-ray image intensifier as claimed in claim 1, wherein said electrode is a coating of semiconductor material having a sheet resistance increasing with increasing distance from said input luminescent screen.

3. An x-ray image intensifier as claimed in claim 1 wherein said one-piece electrode substrate is conically shaped.

4. An x-ray image intensifier as claimed in claim 1 wherein said one-piece electrode substrate is cylindrically shaped.

5. An x-ray image intensifier as claimed in claim wherein said one-piece electrode substrate is cylindrically shaped and includes a plurality of successive, stepped sections of respectively different diameters.

* * * * *